US012270550B2

(12) United States Patent
Funk

(10) Patent No.: US 12,270,550 B2
(45) Date of Patent: Apr. 8, 2025

(54) HOUSING ASSEMBLY FOR AN APPLIANCE

(71) Applicant: Electrolux Home Products, Inc., Charlotte, NC (US)

(72) Inventor: Gregory Funk, Nashville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 825 days.

(21) Appl. No.: 17/350,383

(22) Filed: Jun. 17, 2021

(65) Prior Publication Data

US 2022/0404033 A1 Dec. 22, 2022

(51) Int. Cl.
*F24C 15/30* (2006.01)

(52) U.S. Cl.
CPC ..... *F24C 15/30* (2013.01)

(58) Field of Classification Search
CPC ..... F24C 15/30; F24C 15/023; F24C 15/08
USPC ..... 126/198, 273 R, 50, 273 A
See application file for complete search history.

(56) References Cited

U.S. PATENT DOCUMENTS

| | | | | |
|---|---|---|---|---|
| 343,511 | A | 6/1886 | White | |
| 994,337 | A | 6/1911 | Richardson | |
| 1,980,781 | A | 11/1934 | Busiek | |
| 2,055,564 | A | 9/1936 | Tinnerman | |
| 2,078,581 | A | 4/1937 | Geza | |
| 2,384,272 | A | 8/1940 | Baxter | |
| 2,335,279 | A | 11/1943 | Hobson | |
| 2,447,364 | A | 8/1948 | Renshaw | |
| 2,775,237 | A | 12/1956 | Chadwick | |
| 3,213,847 | A | 10/1965 | Scott | |
| 4,009,795 | A | 3/1977 | Hurko et al. | |
| 4,163,344 | A * | 8/1979 | Scherer | E05F 1/1276 49/389 |
| 4,245,615 | A * | 1/1981 | Moss | F24C 15/08 126/273 R |
| 4,359,250 | A | 11/1982 | Jenkins | |
| 4,414,959 | A | 11/1983 | Fair et al. | |
| 4,886,042 | A * | 12/1989 | Bessler | F24C 15/08 126/21 R |
| 6,045,205 | A | 4/2000 | Dingler | |
| 7,789,081 | B2 | 9/2010 | Raby et al. | |
| 10,436,513 | B2 | 10/2019 | Chivers | |

(Continued)

FOREIGN PATENT DOCUMENTS

| | | |
|---|---|---|
| CN | 1769789 | 5/2006 |
| CN | 108464650 | 8/2018 |

(Continued)

OTHER PUBLICATIONS

DE 9106422 U1 Machine Translation.pdf, machine translation, EPO.org Aug. 6, 2021.

(Continued)

*Primary Examiner* — Vivek K Shirsat
(74) *Attorney, Agent, or Firm* — Chrisman Gallo Tochtrop LLC

(57) ABSTRACT

An appliance housing assembly is configured for improved load distribution. The assembly includes first and second side panels, each including a pair of vertical support columns configured to carry the loads of the appliance to the appliance support surface. The assembly further includes common components that can be use across various different assembly configurations.

18 Claims, 10 Drawing Sheets

(56) References Cited

U.S. PATENT DOCUMENTS

| | | | | |
|---|---|---|---|---|
| 2007/0246038 | A1* | 10/2007 | Raby | F24C 15/08 126/273 R |
| 2009/0194089 | A1 | 8/2009 | Durney et al. | |
| 2018/0010808 | A1 | 1/2018 | Mill | |
| 2020/0033009 | A1 | 1/2020 | Lee | |

FOREIGN PATENT DOCUMENTS

| | | |
|---|---|---|
| DE | 9106422 | 7/1991 |
| DE | 202004013917 | 10/2004 |
| DE | 102005036815 | 2/2007 |
| DE | 202019105241 | 11/2019 |
| EP | 0034135 | 8/1981 |
| EP | 0077928 | 5/1983 |
| FR | 914225 | 10/1946 |
| GB | 464153 | 4/1937 |
| JP | 03102119 | 4/1991 |
| JP | 05033952 | 2/1993 |
| KR | 20030079555 | 10/2003 |
| KR | 100646880 | 2/2006 |
| KR | 20060013872 | 2/2006 |
| WO | WO2004070278 | 8/2004 |
| WO | WO2010034833 | 4/2010 |
| WO | WO2021005548 | 1/2021 |

OTHER PUBLICATIONS

Memmert. Universal Oven UF75plus. https://www.memmert.com/products/heating-drying-ovens/universal-oven/UF75plus/. 10 pages.
International Search Report and Written Opinion for PCT/US2020/065072, dated Apr. 6, 2021, 13 pages.

* cited by examiner

HOUSING ASSEMBLY FOR AN APPLIANCE

1. FIELD OF THE INVENTION

The following description relates generally to an assembly for a cooking appliance.

2. DESCRIPTION OF RELATED ART

Household cooking appliances can have a "uni-body" construction in which the load-carrying, structural aspects are provided by the same elements that provide the architectural or aesthetic features of the appliance. For example, a kitchen range can have a housing assembled from a front frame, a rear panel, a right-side panel, and a left-side panel. A pair of base rails extend between the front and rear panels and mount a plurality of foot assemblies that support the housing relative to the floor. A cooktop for use with a plurality of conventional burners (not shown) is attached to the top of the housing. A cooking chamber, or oven cavity, is sandwiched between and supported by the front frame and the rear panel.

The front frame, rear panel, right-side panel, and left-side panel are typically large, planar elements. Not only do they serve as an aesthetically pleasing enclosure, but each also can provide structural support for the oven housing, the cooktop, the burners, a control panel, a drawer, and other such elements typically found in a conventional household cooking range. For example, an oven door is typically coupled directly to the front frame by a hinge assembly (not shown). The hinge assembly includes a hinge mounted to the door and a corresponding receiver attached to the front frame. Thus, the thin sheet metal that comprises the front frame substantially carries the full load of the door. For this reason, the front frame generally extends the full length of the front side of the oven.

SUMMARY

The following presents a simplified summary in order to provide a basic understanding of the embodiments described herein. This summary is not an extensive overview nor is it intended to identify key or critical elements. Its sole purpose is to present some concepts in a simplified form as a prelude to the more detailed description that is presented later.

According to one embodiment, a housing assembly for a cooking appliance is provided. The housing assembly includes: first and second opposed side panels, each of the first and second side panels having integral front and rear vertical support columns; a front frame secured to the front vertical support columns of the first and second side panels; a rear component plate secured to the rear vertical support columns of the first and second side panels; and an oven cavity enclosed by the first and second side panels, the front frame, and the rear component plate, the oven cavity coupled to the rear vertical support columns of the first and second side panels.

According to another embodiment, a housing assembly for an appliance includes: a first side panel and a second side panel, each of the first and second side panels having a horizontal axis of symmetry and a vertical axis of symmetry; first front and rear vertical support columns integrated with the first side panel, the first front and rear vertical support columns forming first and second load paths; and second front and rear vertical support columns integrated with the second side panel, the second front and rear vertical support columns forming third and fourth load paths. Additionally, all loads in the appliance travel through one or more of the first, second, third, and fourth load paths.

According to another embodiment, a housing assembly for an appliance is provided. The housing assembly includes: a first side panel having a first pair of vertical support columns; a second side panel positioned opposite the first side panel and having a second pair of vertical support columns; an oven cavity positioned between the first side panel and the second side panel; a rear component plate secured to and configured to support the oven cavity, a first side of the rear component plate secured to one of the first pair of vertical support columns and a second side of the rear component plate secured to one of the second pair of vertical support columns; a first door hinge component secured to at least one of the first pair of vertical support columns; and a second door hinge component secured to at least one of the second pair of vertical support columns.

Other features and aspects will be apparent from the following detailed description, the drawings, and the claims.

BRIEF DESCRIPTION OF THE DRAWINGS

Throughout the drawings and the detailed description, unless otherwise described, the same drawing reference numerals can be understood to refer to the same elements, features, and structures. The relative size and depiction of these elements may be exaggerated for clarity, illustration, and convenience.

DETAILED DESCRIPTION

Figure 1:
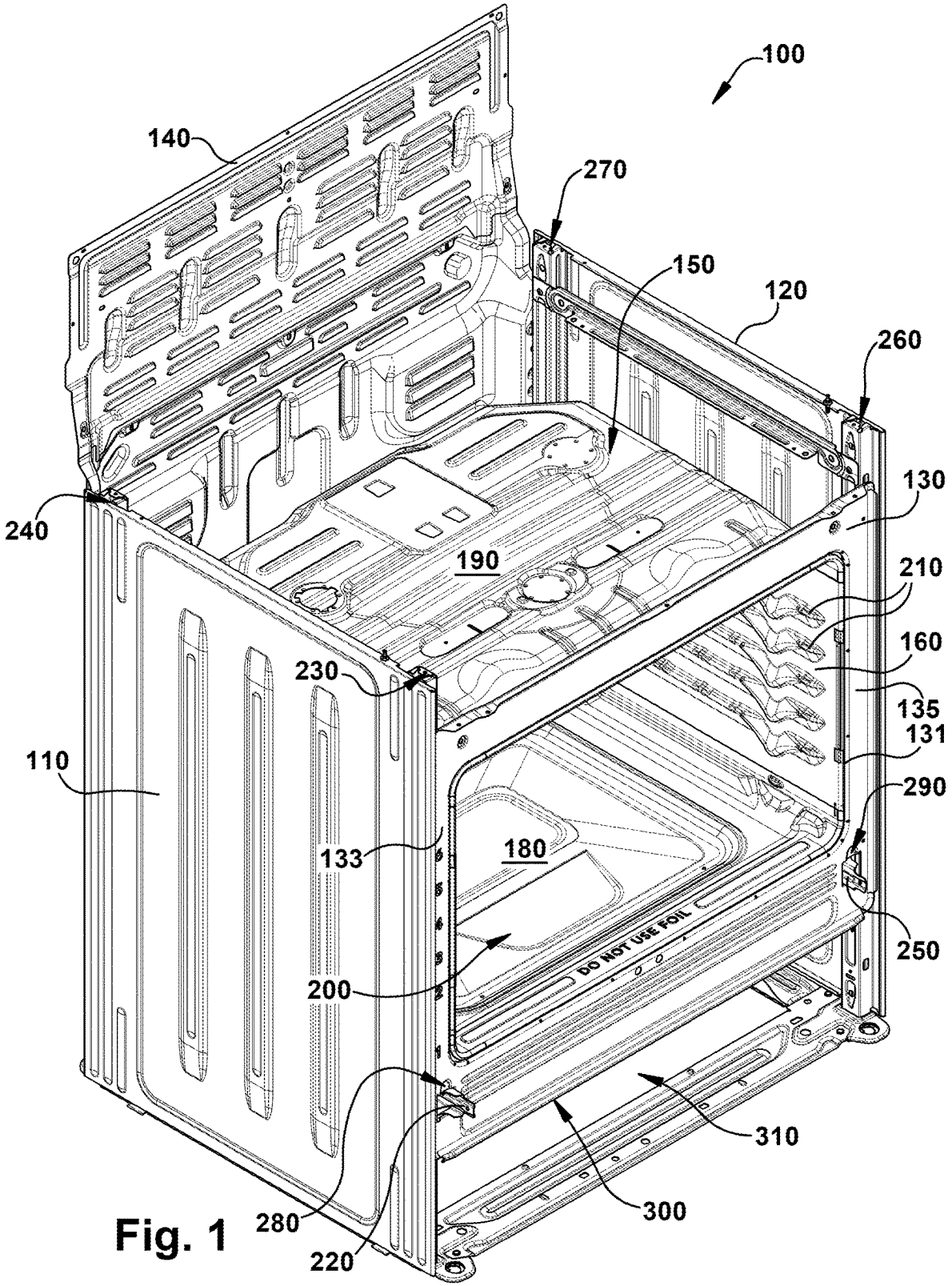
FIG. 1 illustrates a perspective view of an oven housing assembly in accordance with an embodiment.

Example embodiments are described and illustrated herein. These illustrated examples are not intended to be a limitation on the present embodiments. For example, one or more aspects of the system can be utilized in other embodiments and other types of appliances. Such systems may, however, be embodied in many different forms and should not be construed as limited to the embodiments set forth herein. Like, but not necessarily the same, elements in the various figures are denoted by like reference numerals for consistency. Terms such as "first," "second," "front," and "rear" are used merely to distinguish one component (or part of a component or state of a component) from another. Such terms are not intended to denote a preference or a particular orientation.

FIGS. 1-10 illustrate example housing assemblies and components thereof for a cooking appliance. The illustrated cooking appliance is a freestanding oven range, however, the housing assembly described herein, including one or more components, may be applicable to various other structures and appliances, such as a dishwasher, a furnace, a rotisserie, a kiln, or the like. Turning initially to FIG. 1, a perspective view of an example oven housing assembly 100 is shown. An oven door, storage drawer, cooktop, and control panel, as are typically provided with an oven, are not shown for purposes of more clearly illustrating the assembly of the housing components. The oven housing assembly 100 includes first side panel 110 and a second side panel 120 positioned opposite the first side panel 110. Positioned between the first and second side panels 110, 120 are a front frame 130 and a rear panel 140. An oven cavity 150 is substantially enclosed by the first side panel 110, second side panel 120, front frame 130, and rear panel 140. The oven cavity 150, also referred to as an oven wrapper, includes opposing sidewalls 155, 160, rear wall 170, bottom wall 180, and top wall 190 with a front opening 200. The front opening 200 is registered to a central opening 131 in the front frame 130, and can be closed by an oven door (not shown). Each of sidewalls 155, 160 of the oven cavity 150 can include a plurality of guide rails 210 for receiving cooking racks and the like thereon. A cooktop (not shown) is positioned at a top portion of the oven housing assembly 100 above the top wall 190 of the oven cavity 150. Alternate embodiments of the cooking appliance can include only an oven cavity, without the cooktop, and can be used in a variety of different configurations such as built-in gas ovens, etc. In addition, the appliance may include more than one oven cavity. For example, the appliance may include two oven cavities (a "double-cavity" configuration). A double-cavity configuration may be used in a built-in wall oven, freestanding range, or other configurations. However, configurations are not limited thereto, and more than two oven cavities may be included in other embodiments. For the sake of brevity, however, the embodiment of the cooking appliance illustrated herein will be used as an example to describe the oven housing assembly.

The oven door, which is used to close the oven cavity opening 200, is pivotally mounted to the oven housing assembly 100 at a position below the oven cavity opening 200 such that when the oven door is fully open, an interior of the oven cavity 150 is fully accessible. The oven door is pivoted about a generally horizontal axis between a horizontal position in which the oven cavity opening 200 is fully open and a vertical position in which the oven cavity opening 200 is closed by the oven door. Alternatively, the oven door may be mounted at a left-side and/or a right-side of the oven cavity opening 200. In this configuration, the oven door can be pivoted about a vertical axis adjacent to one or both sides of the oven cavity 150. The housing assembly 100 includes oven door hinge assemblies to facilitate movement of the oven door about its pivot axis. Each hinge assembly includes a hinge component and a receiver component. As will be described in greater detail below, a first hinge component 220 is coupled to the first side panel 110 via a front vertical support column 230 and optionally, also to a rear vertical support column 240. Likewise, a second hinge component 250 is coupled to the second side panel 120 via a front vertical support column 260 and optionally, also to a rear vertical support column 270. Thus, one hinge component 220, 250 is provided at each side of the oven cavity 150. The vertical support columns can be provided via sheet-metal bends in sheet metal comprising or forming the respective side panels.

The front frame 130 includes a first hinge opening 280 positioned at a first lower side portion of the front frame 130 and a second hinge opening 290 positioned at a second, opposing, lower side portion of the front frame 130. The first and second hinge openings 280, 290 are sized and shaped such that end portions of corresponding hinge components 220, 250 can extend therethrough. The end portions of the hinge components 220, 250 are configured to engage with corresponding receiver components (not shown) secured within the oven door. The first and second hinge openings 280, 290 allow the end portions of the hinge components 220, 250 to merely pass therethrough. In other words, the front frame 130 provides no structural support to the hinge assemblies or any components thereof.

The front frame 130 has a central opening 131 that corresponds with the oven cavity opening 200 such that the oven cavity 150 is accessible through the front frame 130. A first side 133 of the front frame 130 is secured to a front side portion of the front vertical support column 230 of the first side panel 110 via fasteners or the like. Likewise, a second side 135 of the front frame is secured to a front side portion of the front vertical support column 260 of the second side panel 120 via fasteners or the like. Thus, the front frame 130 is fully supported by the front vertical support columns 230, 260 and provides structural rigidity to the housing assembly. The position of the front frame 130 between the front vertical support columns 230, 260 further provides a large component of squareness of the housing for strength. However, no primary load paths are carried by the front frame 130. Accordingly, the front frame 130 does not need to carry primary loads to the support surface and thus, a lower edge 300 of the front frame 130 can terminate at a position adjacent a lower edge of the oven door and substantially above a lower space 310 provided in the oven housing assembly 100. The lower space 310 is configured for use as a storage drawer, a warming drawer, and/or as another oven cavity and is located below (optionally defined by) the bottom wall 180 of the oven cavity 150. The lower space 310 also is bounded by lower portions of the first and second side panels 110, 120, a lower portion of rear panel 140, and a support surface of the oven housing assembly 100, such as a floor. Thus, the entire front frame 130 is positioned above at least one of a storage drawer, a warming drawer, and an oven cavity provided at a lower portion of the appliance, within the lower space 310.

Figure 2:
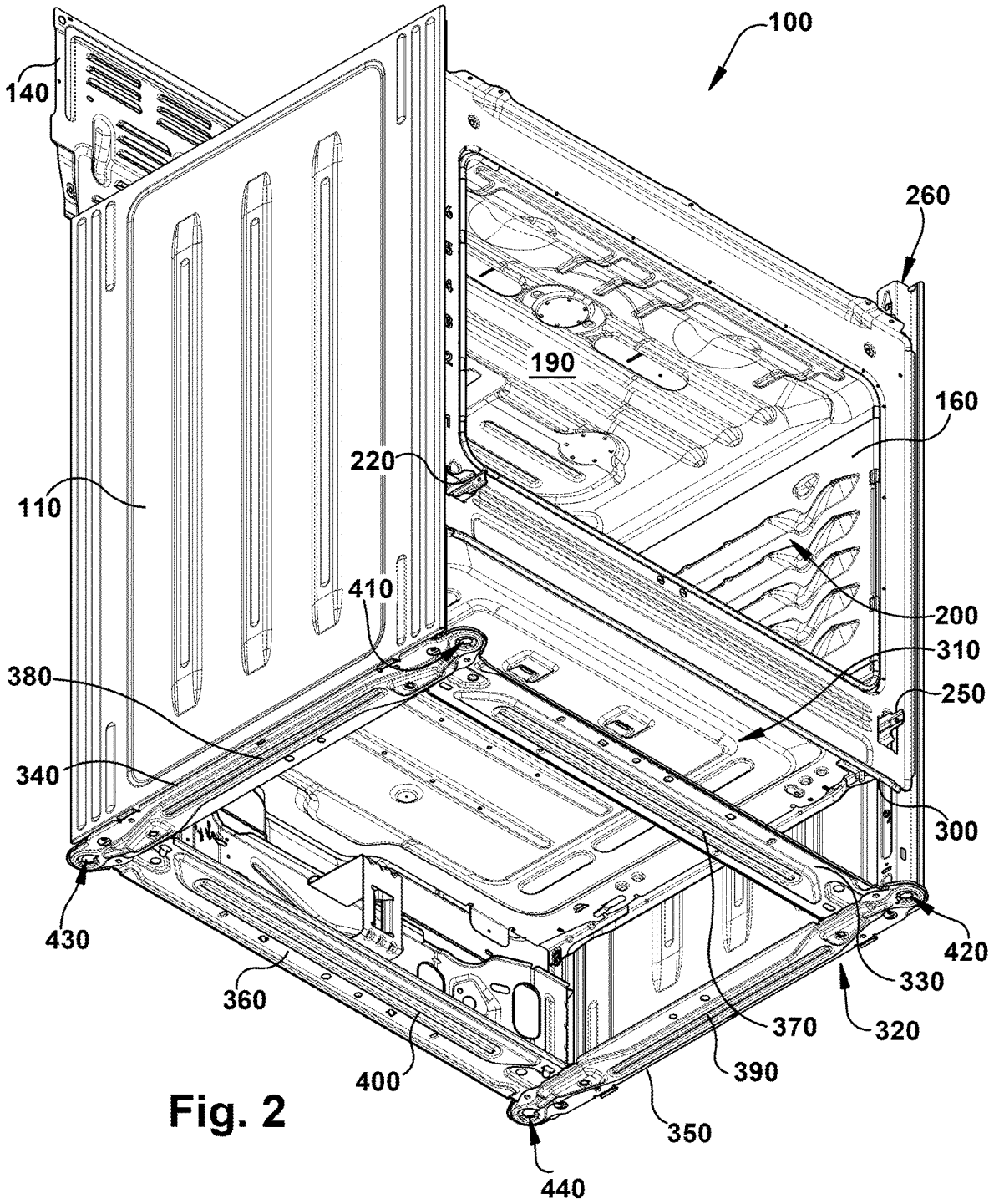
FIG. 2 illustrates a bottom perspective view of an oven housing assembly in accordance with an embodiment.

Turning now to FIG. 2, a bottom perspective view of the oven housing assembly 100 is illustrated. At a bottom portion of the assembly 100 a lower support frame 320 is provided. The lower support frame 320 includes a front base rail 330, a first side base rail 340, a second side base rail 350 positioned opposite the first side base rail 340, and a rear base rail 360 positioned opposite the front base rail 330. Each of the base rails 330, 340, 350, 360 is preferably made of metal, such as stamped sheet metal and can include one or more longitudinally extending ribs or beads 370, 380, 390, 400 to provide strength to the corresponding base rails 330, 340, 350, 360, respectively. The front base rail 330 includes a pair of forwardly extending flanges, one at each side. A first front flange includes a first aperture 410 and a second front flange includes a second aperture 420. The first and second side base rails 340, 350 each include corresponding apertures at their respective front-end portions and are configured for alignment with the first and second apertures 410, 420 of the front base rail 330. Similarly, the rear base rail 360 includes a pair of rearwardly extending flanges, one at each side. A first rear flange includes a third aperture 430 and a second rear flange includes a fourth aperture 440. The first and second side base rails 340, 350 each includes corresponding apertures at their respective rear end portions and are configured for alignment with the third and fourth apertures 430, 440.

A foot (not shown) can be threaded through each of the apertures 410, 420, 430, 440 to couple the rails 330, 340, 350, 360 together and to provide adjustable and/or nonadjustable feet for the appliance. As shown, the apertures 410, 420, 430, 440 and thus, the feet extending therethough, are positioned forwardly of the front frame 130 of the oven housing assembly 100 and rearwardly of the rear panel 140 of the oven housing assembly 100 to facilitate balancing of the loads and to mitigate tipping of the appliance, such as when a load from an open oven door will introduce a moment about its (horizontal) pivot axis that might otherwise tend to cause the appliance to tip forward. In the illustrated embodiment, all downward forces at the front of the appliance are accumulated and directed down the front vertical support columns 230, 260, and then ultimately into the front feet (not shown) received within apertures 410 and 420, which are located forward of those columns 230, 260 and thus better able to counteract the tipping moment of the open door.

According to one example, aperture 410 may have an adjustable leveling foot extending through the aperture 410; while apertures 420, 430, and 440 may include a downwardly extending projection or nonadjustable foot extending therethrough. Any suitable combination of adjustable and nonadjustable feet can be provided. The front and rear base rails 330, 360 can be of the same or substantially the same configuration such that during assembly, the front and rear base rails 330, 360 are interchangeable. Optionally, they may be laterally symmetrical such that upon rotating a front base rail 330 about a vertical axis, it become suitable as a rear base rail 360, wherein the left- and right-hand portions of each are symmetric with one another. Additionally, the first and second side base rails 340, 350 can be of the same or substantially the same configuration such that during assembly, the first and second side base rails 340, 350 are interchangeable. Similarly, side base rails 340, 350 also may be symmetrical such that the front- and rear-portions thereof are symmetric with one another. Thus, the oven housing assembly 100 requires fewer part variants as compared to conventional assemblies, which reduces complexity in both assembly and inventory, or part storage. That is, a single part (SKU) can serve as both the left- and right-hand side base rails 340, 350 during assembly of the appliance, while another single part or SKU can serve as both the front- and rear base rails 330, 360.

Figure 3:
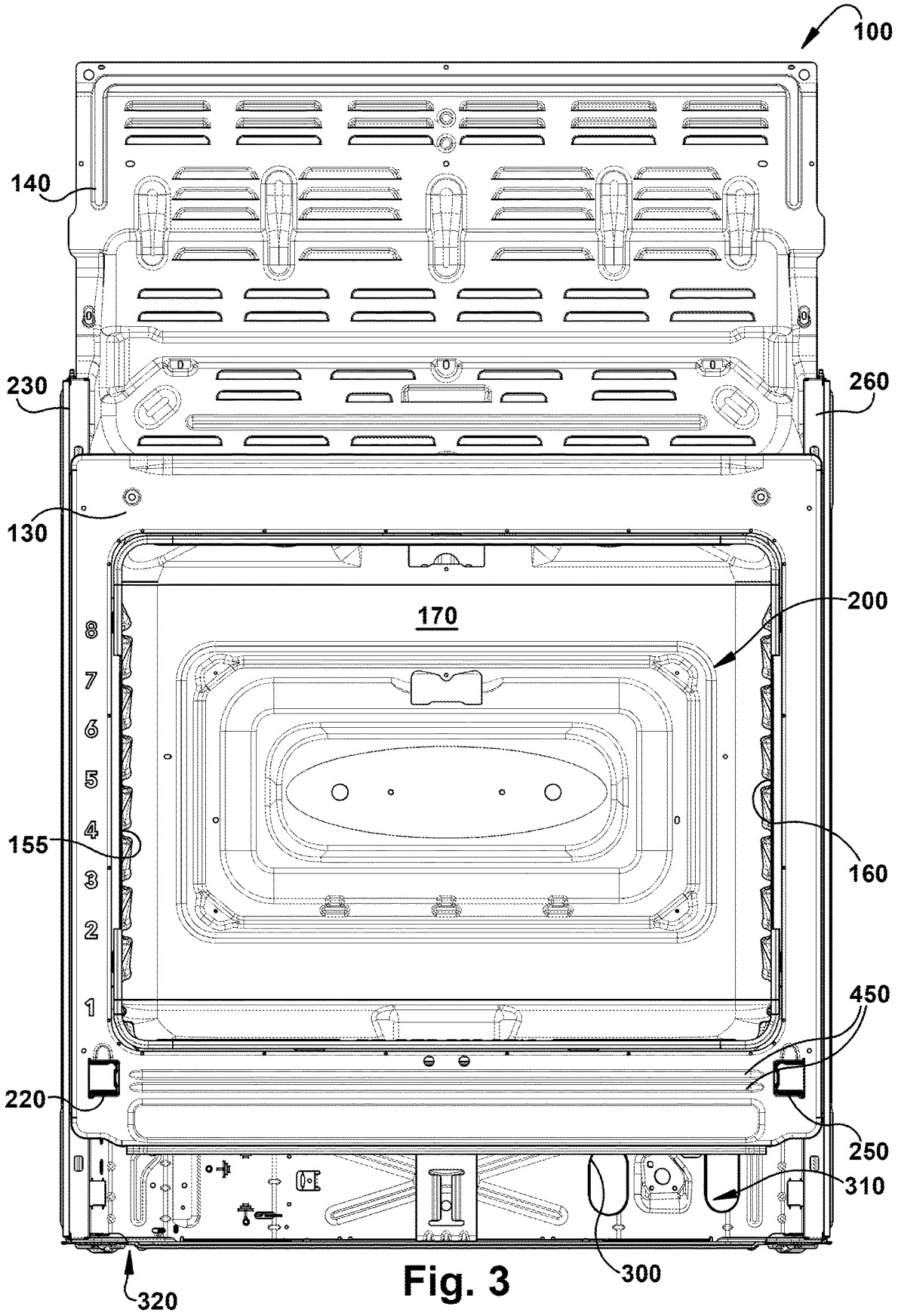
FIG. 3 illustrates a front view of an oven housing assembly in accordance with an embodiment.

FIG. 3 illustrates a front view of the oven housing assembly 100. The front frame 130 includes at least one, and preferably a plurality of, strengthening ribs 450, which provides strength at the lower portion of the front frame 130. Because the front frame 130 substantially does not carry loads, the lower edge 300 of the front frame 130 truncates near a bottom of the oven door and above lower space 310. This is in contrast to conventional assemblies in which the front frame carries loads from the oven door hinge assemblies (and thus from the door itself) and from an overlying cooktop assembly or hob, and thus extends to a bottom of the oven assembly to facilitate distribution of such loads to the oven support surface. Without interference from a front frame structure, a storage drawer, warming drawing, or oven cavity provided in the lower space 310 can be wider than conventional assemblies. For example, a useable width in the lower space 310, such as for storage, warming, and/or cooking, can be equal to or greater than a width of the oven cavity 150, as defined by a distance between first sidewall 155 and second sidewall 160 of the oven cavity 150. This increased width in the lower space 310 provides for the storage of oven racks used in the oven cavity 150 or the interchangeable use of oven racks between the oven cavity 150 and a warming drawer or second oven cavity positioned within the lower space 310.

Figure 4:
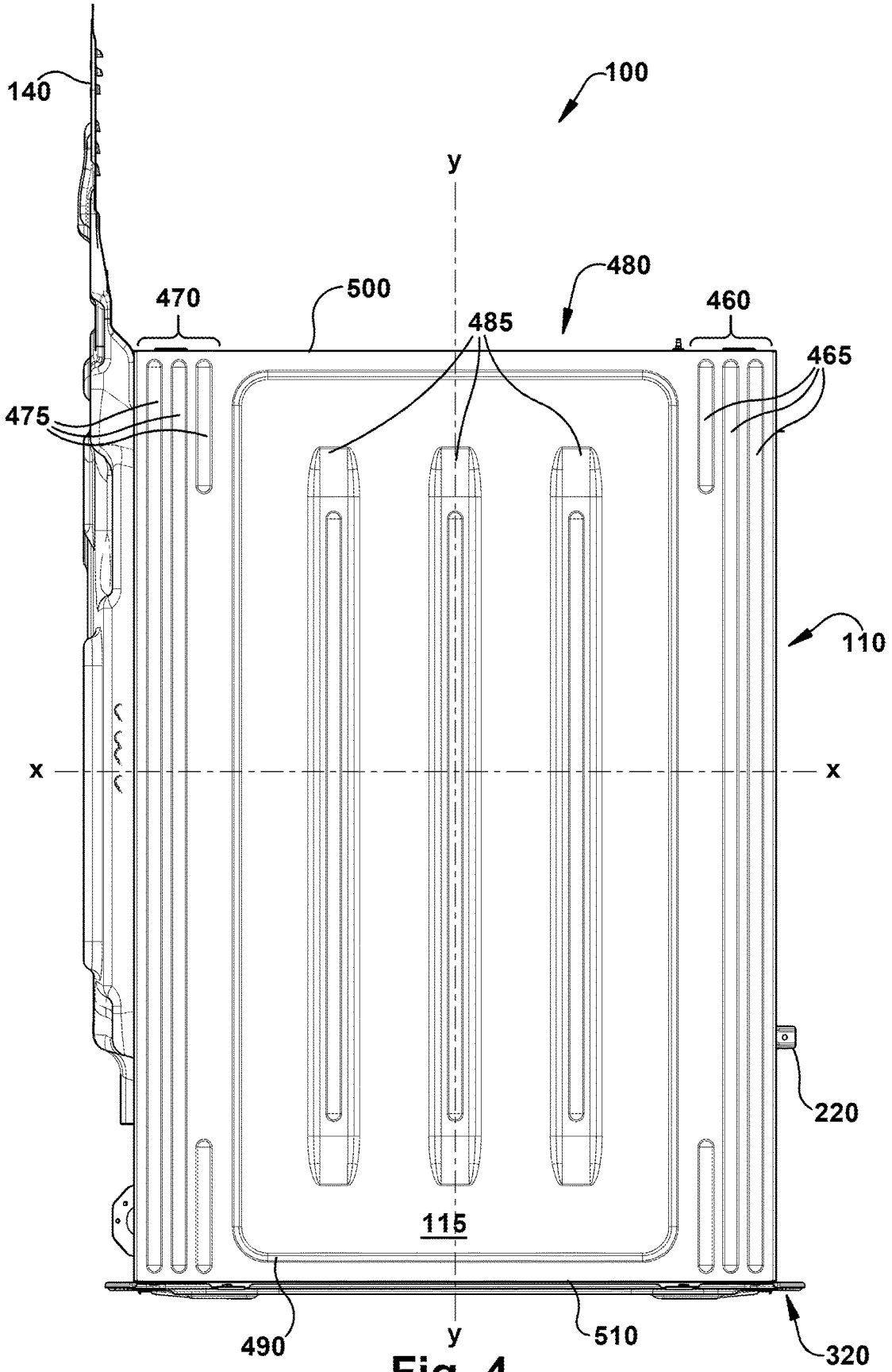
FIG. 4 illustrates a side view of an oven housing assembly in accordance with an embodiment.

FIG. 4 illustrates a side view of the oven housing assembly 100 in which an exterior face 115 of the side panel 110 is shown. The side panel 110 includes a plurality of strengthening or reinforcement features (such as ribs) to provide structural integrity to the side panel 110. Each of the features can be materially integral with the side panel 110 and can be added via a stamping process, for example. A front portion 460 of the side panel 110 can include one or more first vertically extending strengthening features 465. Likewise, a rear portion 470 of the side panel 110 can include one or more second vertically extending strengthening features 475. The first and second strengthening features 465, 475 provide support to the front and rear portions 460, 470, which carry the front and rear vertical support columns on an interior face of the side panel 110. A center portion 480 of the side panel 110 can include third and fourth strengthening features 485, 490, as desired. It is to be appreciated that any suitable number, shape, and size strengthening features can be provided on the side panel 110.

The side panel 110 (including all integrated support columns and reinforcement features) has a vertical axis of symmetry Y and preferably also a horizontal axis of symmetry X, thereby rendering the side panel 110 right and left side agnostic as well as suitable as either a left-hand or a right-hand side panel regardless which end is up. In other words, the configuration of the side panel 110 and its features preferably are symmetrical about a horizontal axis X extending through a center of the side panel 110. For example, as shown in FIG. 4, the side panel 110 includes a first horizontal end 500 positioned at a top portion of the oven housing assembly 100 and a second horizontal end 510 positioned at a bottom of the oven housing assembly and in contact with a corresponding base rail. The configuration of the side panel and its strengthening features are shown such that they are the same when the side panel 110 is oriented in the manner shown and when the side panel 110 is rotated 180-degrees such that the first horizontal end 500 is positioned at the bottom and in contact with the corresponding base rail and the second horizontal end 510 is positioned at the top portion of the housing. Additionally, the configuration of the side panel 110 and its features are symmetrical about a vertical axis Y extending through the center of the side panel 110. This allows the side panel 110 to be positioned at either a left side or a right side of the oven housing assembly. Thus, if positioned on the opposite side of the oven, front portion 460 would be positioned at a rear of the oven housing and rear portion 470 would be positioned at a front of the oven housing. Such configuration further reduces the part variants needed in the assembly as compared to conventional assemblies that use right and left specific side panel configurations, because now a single part or SKU can be used for both left- and right-hand side panels. Additionally, by using the same part configuration for both the right and left side, assembly of the housing is simplified, as either a user or robot only need to verify that the vertical support columns are facing inwards, towards the oven cavity 150.

Figure 5:
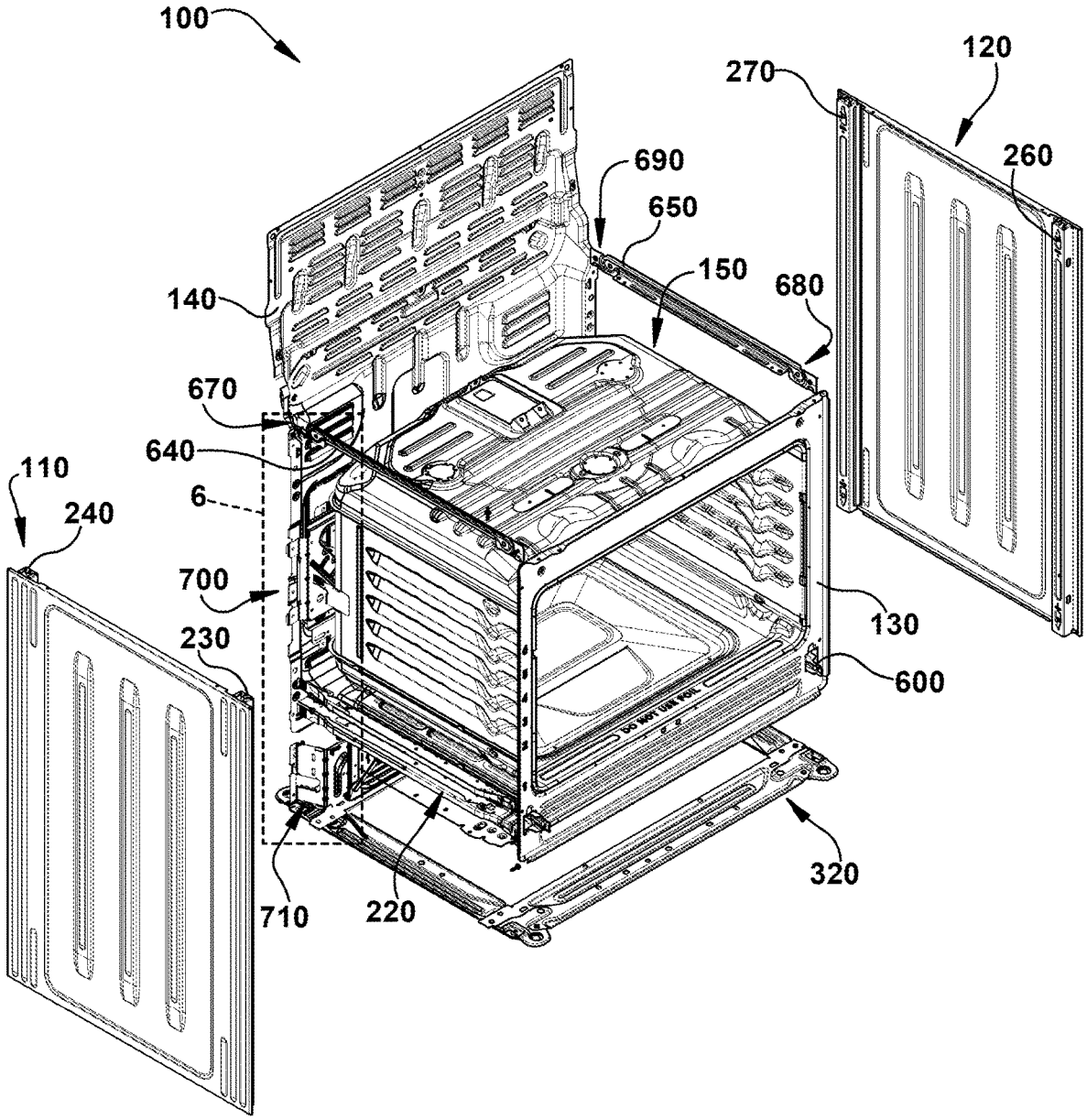
FIG. 5 illustrates a partially exploded front perspective view of an oven housing assembly in accordance with an embodiment.
Figure 6:
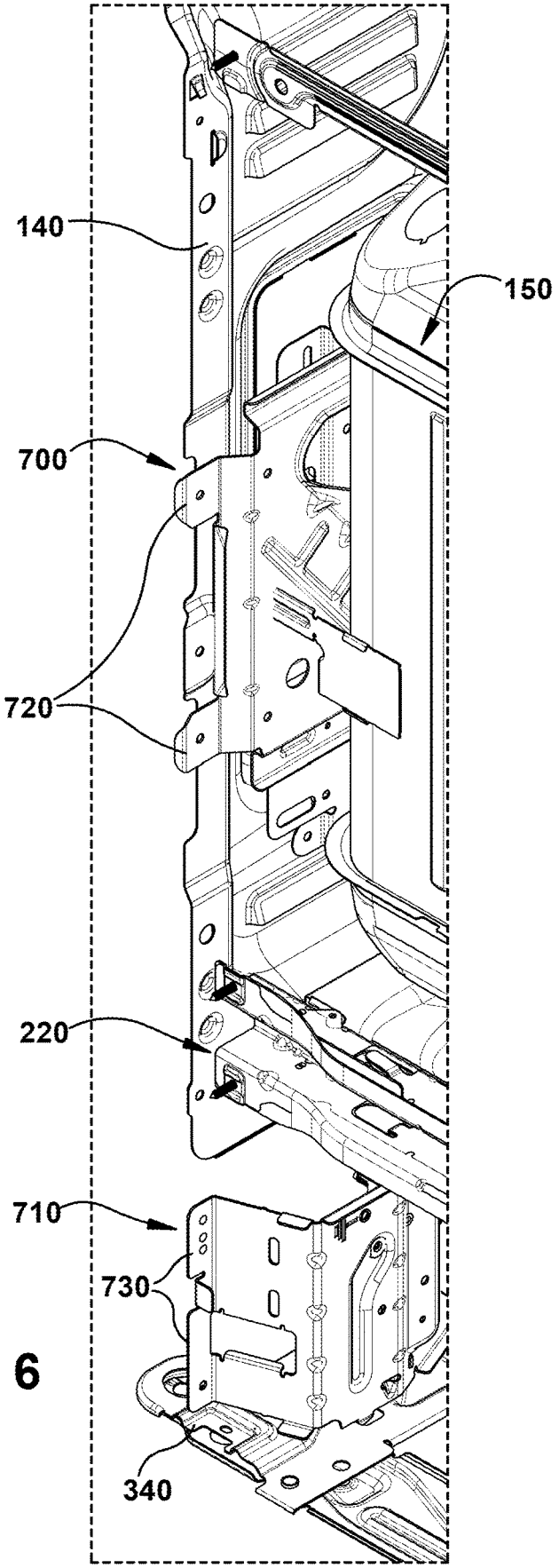
FIG. 6 illustrates a detailed view of a portion of FIG. 5 in accordance with an embodiment.
Figure 10:
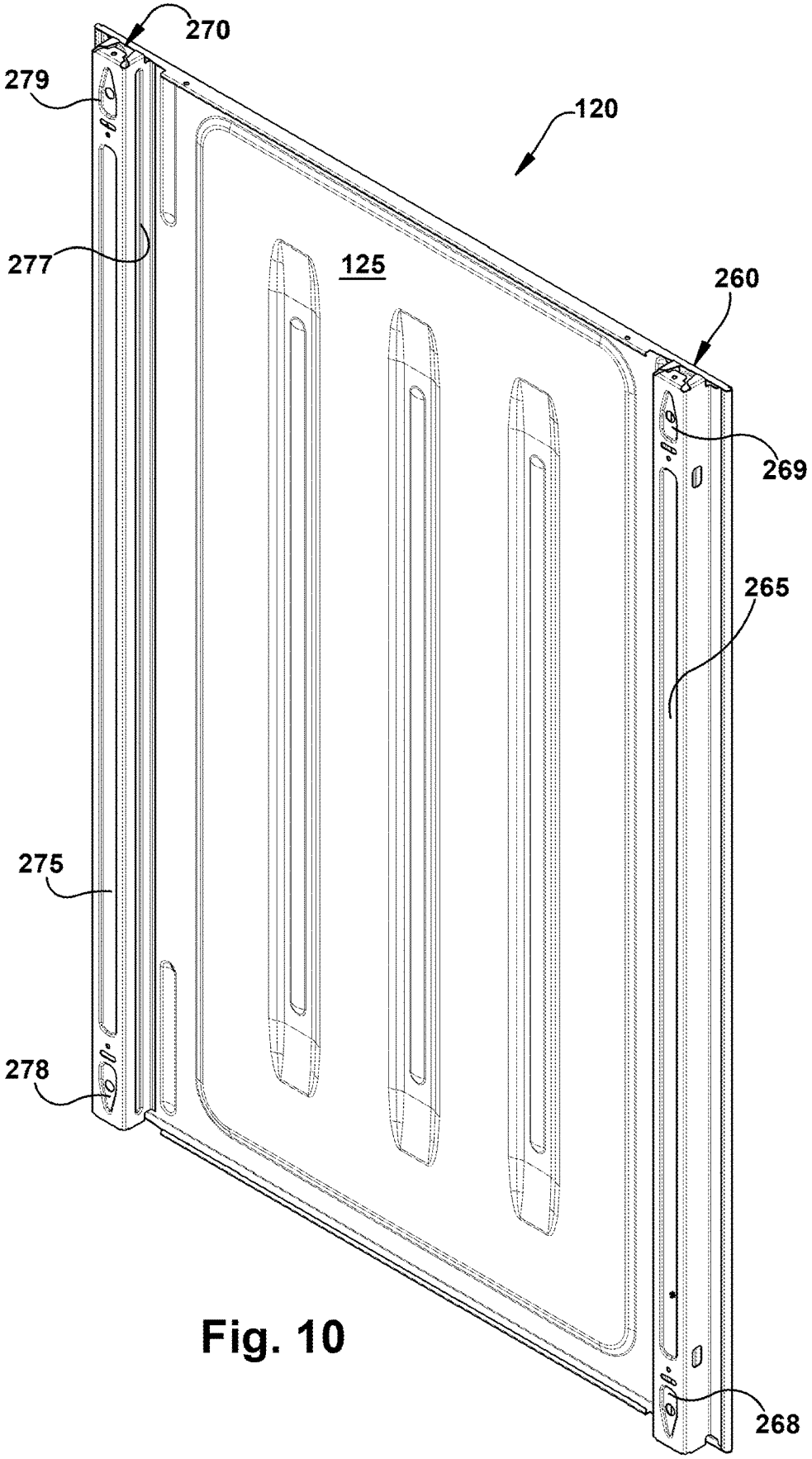
FIG. 10 illustrates a perspective view of a side panel of an oven housing assembly in accordance with an embodiment.

FIG. 5 illustrates a partially exploded view of the oven housing assembly 100. As will be explained in reference to FIGS. 5-7, the structural loads in the assembly are channeled to the vertical support columns 230, 240, 260, and 270. Each vertical support column 230, 240, 260, 270 is positioned at a corner of the housing and can be materially integral with its corresponding side panel. FIG. 10 illustrates an interior face 125 of side panel 120. While side panel 120 is shown and described with respect to FIG. 10, it is to be appreciated that the construction of side panel 120 is identical to the construction of side panel 110. The front and rear vertical support columns 260, 270 can be formed by a metal bending operation in which opposing edge portions of the side panel 120 are bent onto themselves and formed into substantially u-shaped channels. Alternatively, the columns can be separate components fastened with respect to the side panels. The vertical support columns 260 and 270 are identical to each other and like the side panels 110, 120, the vertical support columns each have horizontal and vertical axes of symmetry. The vertical support columns 260 270 include geometric features in order to facilitate attachment and support of various housing components and to improve direction and distribution of load in the appliance. As one example, a hinge or receiver of an oven door hinge assembly is secured to at least one of the vertical support columns 230, 240, 260, and 270 on each side of the oven cavity 150.

Figure 7:
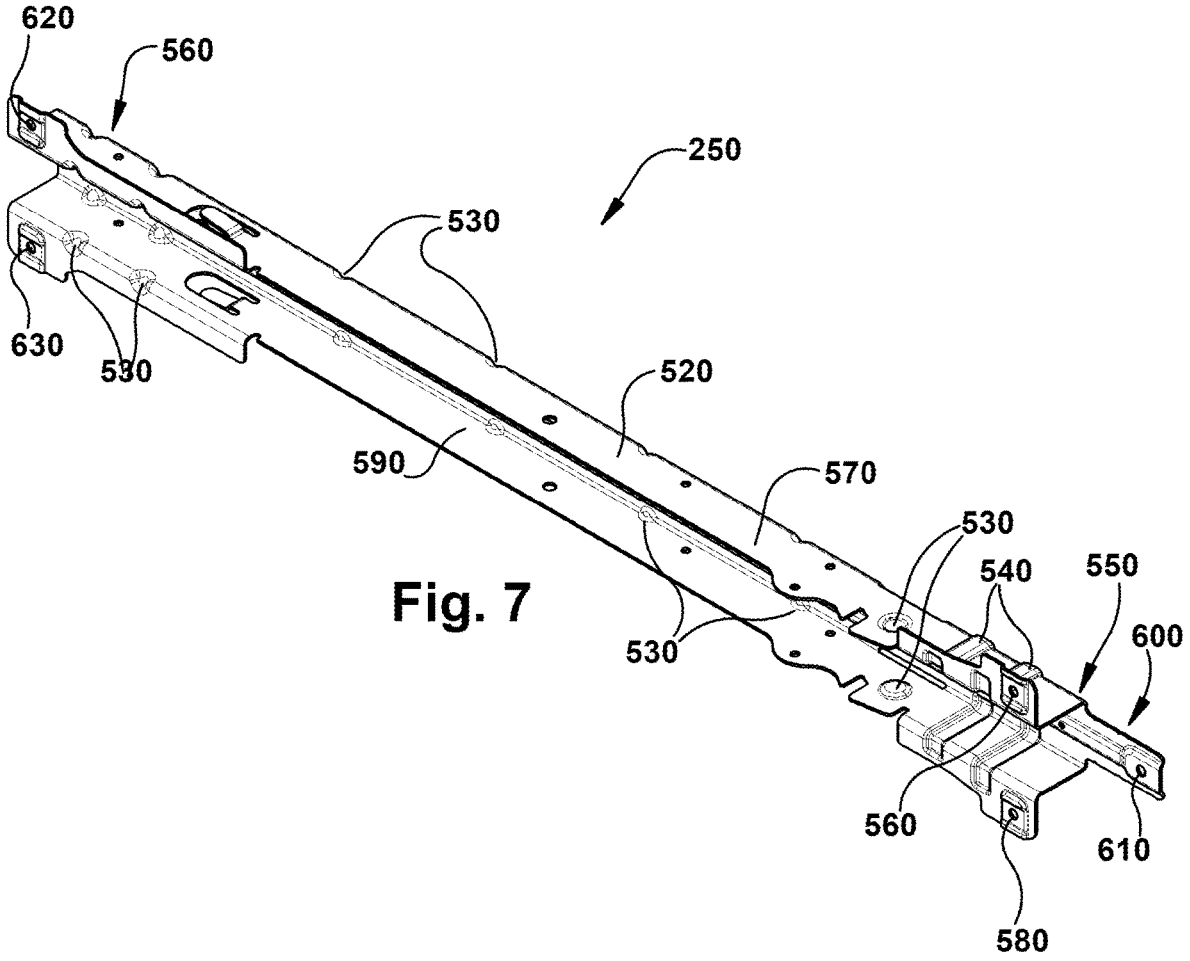
FIG. 7 illustrates an oven hinge housing used in an oven housing assembly in accordance with an embodiment.

Turning back to FIGS. 5-7, in the present embodiment, the oven housing assembly 100 includes body-mounted hinges. As shown in FIG. 5, body-mounted hinge 220 is mounted depthwise within the assembly and extends from a front portion of the oven assembly to a rear portion. FIG. 7 illustrates a hinge housing 520 for body-mounted hinge 250. The hinge housing 520 is an elongated channel having a generally c-shaped cross section and is configured to accommodate conventional hinge components therein, such as a counterbalancing compression spring and roller members. The hinge housing 520 can include a plurality of strengthening beads 530 and at least one strengthening rib 540 to provide structural rigidity. A first end portion 550, which is located near a front portion of the oven, includes at least one tab, and preferably two opposing tabs, that engage the corresponding front vertical support column 260. A first front tab 560 extends outwardly and substantially perpendicularly from a first sidewall 570 of the hinge housing 520, and a second front tab 580 extending outwardly and substantially perpendicularly from a second sidewall 590 of the housing 520. More specifically, the first front tab 560 extends upwards towards a top portion of the appliance and the second front tab 580 extends in an opposite direction, downwards towards the oven support surface. The first and second front tabs 560, 580 are of a width that corresponds to a width W of an elongated, recessed bead 265 in the vertical support column 260. (FIG. 10) Thus, the first and second front tabs 560, 580 can be press fit or fit within lateral edges of the bead 265. Fasteners can be used to secure the first end portion 550 of the hinge housing 520 to the front vertical support column 260. Apertures can be provided in the first and second front tabs 560, 580 to facilitate such connection.

The second end portion 560 of the hinge housing 520 is located near a rear portion of the appliance. The second end portion 560 also includes one or more tabs or extensions that engage an adjacent rear vertical support column 270. Specifically, a first rear tab 620 extends from the first sidewall 570 of the hinge housing 520 and a second rear tab 630 extends from the second sidewall 590 of the hinge housing 520. More specifically, the first rear tab 620 extends upwards towards a top portion of the appliance and the second rear tab 630 extends in an opposite direction, downwards towards the oven support surface. The first and second rear tabs 620, 630 are of a width that corresponds to a width W of an elongated, recessed bead 275 in the rear vertical support column 270. (FIG. 10) Thus, the first and second rear tabs 620, 630 can be press fit or fit within lateral edges of the bead 275. Fasteners can be used to secure the second end portion 560 of the hinge housing 520 to the rear vertical support column 270. Apertures can be provided in the first and second rear tabs 620, 630 to facilitate such connection. A distance between the first front tab 560 and the first rear tab 620, and likewise, a distance between the second front tab 580 and the second rear tab 630 corresponds with a distance between the front vertical support column 260 and the rear vertical support column 270 on side panel 120. Thus, the hinge 250 can be fully supported by the front and rear vertical support columns 260, 270.

The first end portion 550 of the hinge housing 520 further includes a flange 600 having an aperture 610 therein. As shown in FIG. 5, the flange 600 can extend from a base wall of the housing 520 and through a hinge opening in the front frame 130 for attachment to a claw or hanger assembly (not shown). The claw or hanger is used to couple the hinge 250 to a receptacle positioned in a door of the oven. Thus, a portion of the load of the door is transferred via the hinge housing 520 to the front vertical support column 260 via the connection between the tabs 560, 580 and the bead 265. The load is then carried through the bead 265 downward toward the ground or appliance supporting surface. As shown in FIG. 7, the hinge housing 520 has a horizontal axis of symmetry and thus, the same part configuration can be used at a left side of the housing assembly or the right side of the housing assembly. Or in other words, hinge assembly 220 is identical to hinge assembly 250, thereby further reducing the number of distinct parts required in the assembly because a single part or SKU can be used for both left- and right-hand hinge housings.

It is to be appreciated that while a specific hinge housing has been illustrated and described herein, any suitable body-mounted component, such as a body-mounted hinge or body-mounted receiver of any configuration can be employed and still fall within the scope of the present invention. A portion of the body-mounted component is coupled to at least one vertical support column, and sometimes to two vertical support columns, in order to conduct a load of the oven door via vertical support columns (preferably) integrated in the side panels into an adjacent base rail.

Turning back to FIG. 5, at a top portion of the oven housing assembly 100 are first horizontal top rail 640 and second horizontal top rail 650. The first horizontal top rail 640 has a front end 660 secured to a top portion of front vertical support column 230 and a rear end 670 secured to a top portion of rear vertical support column 240. Likewise, the second horizontal top rail 650 has a front end 680 secured to a top portion of front vertical support column 260 and a rear end 690 secured to a top portion of rear vertical support column 270. The first and second horizontal top rails 640, 650 can be used to support a cooktop such that the associated load is conducted downward via the respective vertical support columns. Alternatively, or additionally, the cooktop may be supported by direct contact with a top surface of the vertical support columns 230, 240, 260, and 270. With any configuration, loads from the cooktop are directed downward through the vertical support columns 230, 240, 260, and 270.

At a rear portion of the oven housing assembly 100 is a rear component plate 700 and a lower component plate 710. The rear component plate 700 is secured to a back portion of the oven cavity 150 and is configured to support the oven cavity 150 within the housing. As shown in the detailed view of FIG. 6, each side of the rear component plate 700 includes at least one tab 720 projecting therefrom. Each of the tabs 720 are used to attach the rear component plate 700 to its corresponding rear vertical support columns 240, 270 via suitable fasteners. Thus, loads from the oven cavity 150 are directed downward through the rear vertical support columns 240, 270. The lower component plate 710 is provided at a lower rear portion of the housing assembly and also includes at least one tab 730 projected from each side of the lower component plate 710. Similar to the rear component plate 700, the lower component plate tabs 730 are secured to the corresponding rear vertical support columns 240, 270 via suitable fasteners. Thus, loads from the lower component plate, which typically includes a counterweight, are also directed downward through the rear vertical support columns 240, 270. As also can be seen from FIG. 6, the rear panel 140 is also configured to be secured to the rear vertical support columns 240, 270 via fasteners.

Figure 8:
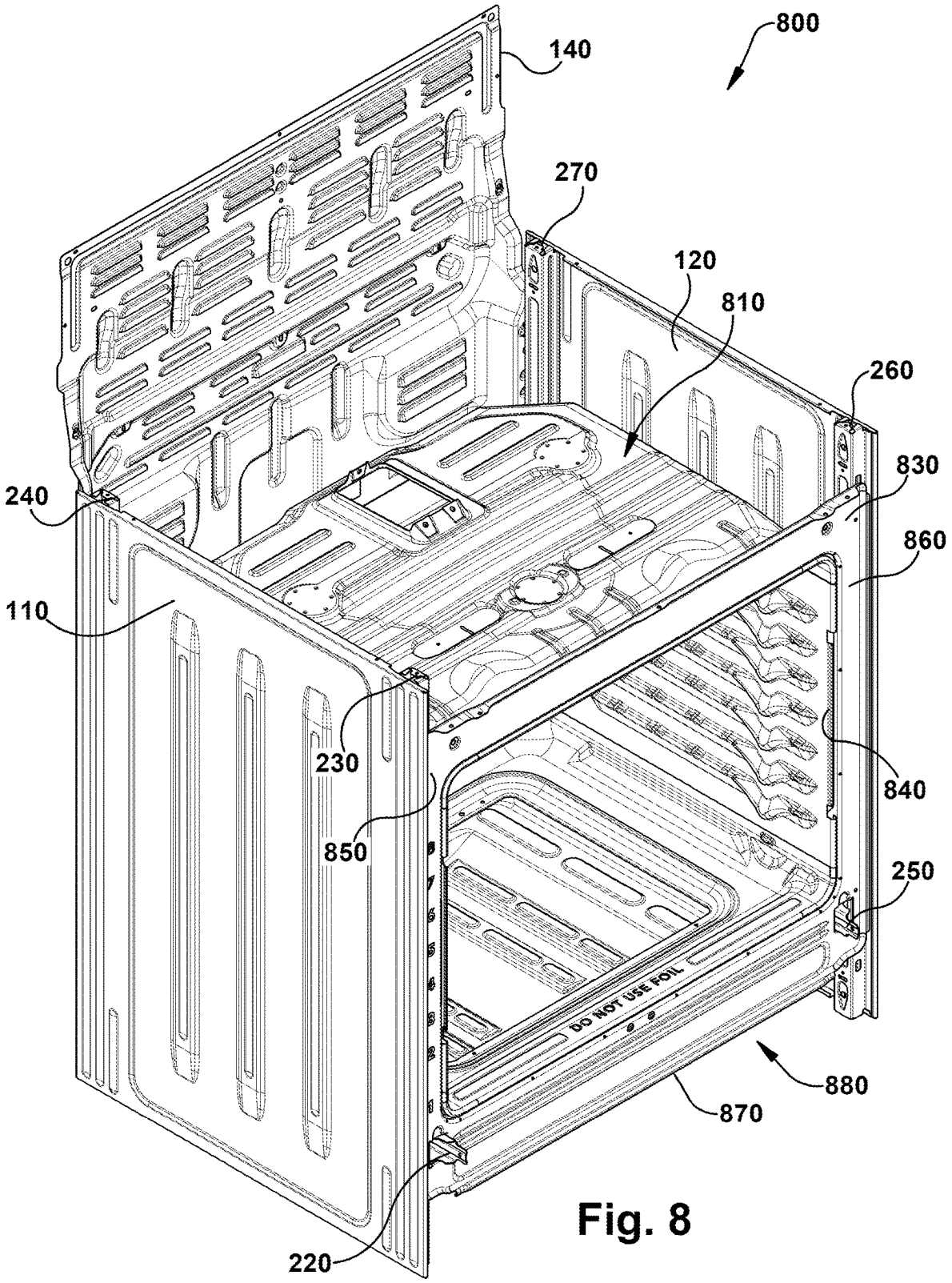
FIG. 8 illustrates a perspective view of an oven housing assembly in accordance with an embodiment.
Figure 9:
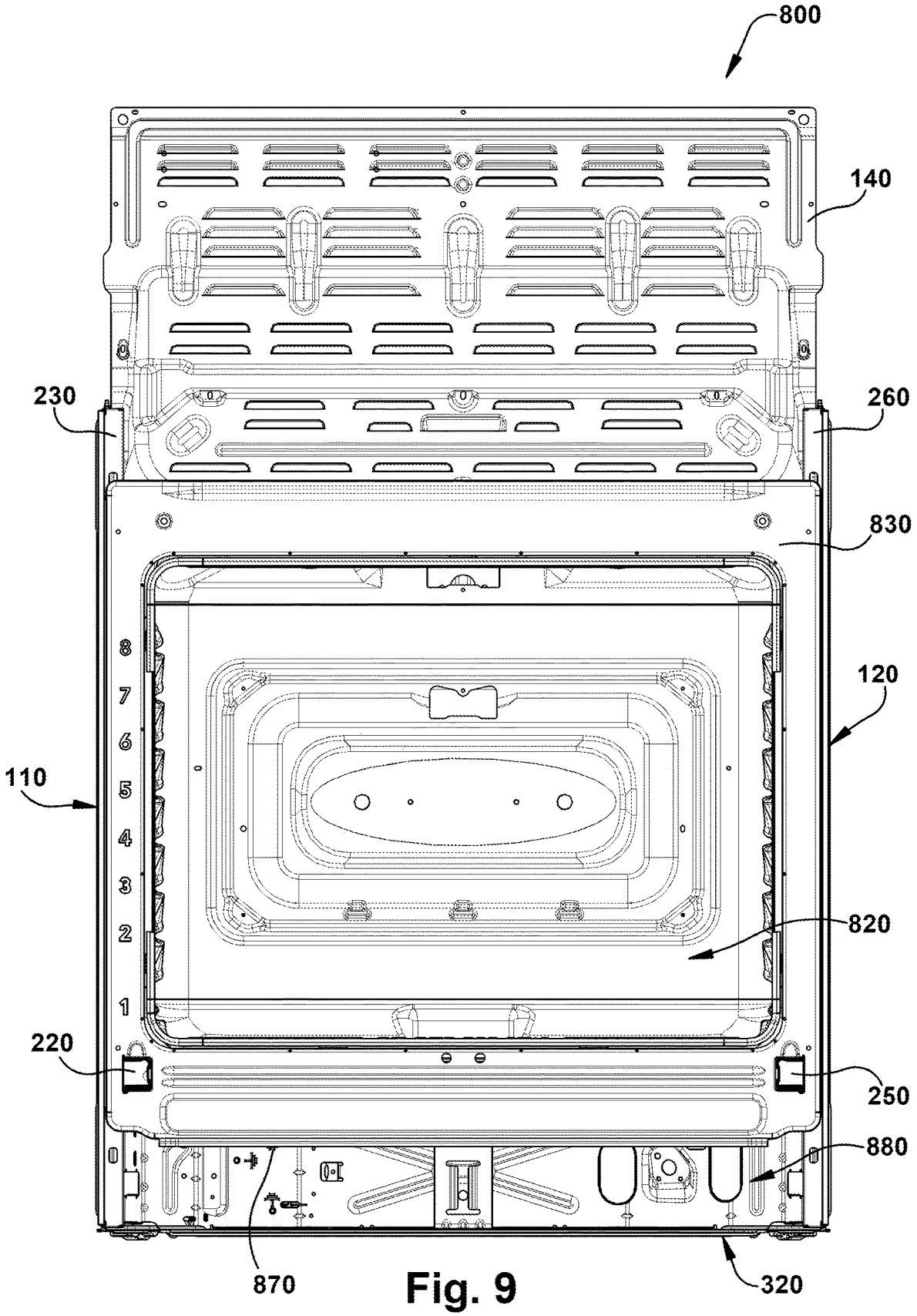
FIG. 9 illustrates a front view of an oven housing assembly in accordance with an embodiment.

FIGS. 8 and 9 illustrate an oven housing assembly 800 that includes a larger capacity oven cavity 810. The oven cavity 810 is of the same depth and width as oven cavity 150 and thus, the oven housing assembly 800 can use many of the same components used in oven housing assembly 100. For example, oven housing assembly 800 includes first and second side panels 110, 120 and rear panel 140. The increased capacity of the oven cavity 810 is a result of an increased height. Thus, a front opening 820 of the oven cavity 810 is larger. A front frame 830 is provided having a central opening 840 that corresponds with the front opening 820 of the oven cavity 810. Similar to front frame 130, front frame 830 includes a first side portion 850 secured to the front vertical support column 230 of the first side panel 110. Likewise, a second side portion 860 of the front frame 830 is secured to the front vertical support column 260 of the second side panel 120. A lower, or bottom, edge 870 of the front frame 830 is positioned below an oven door and above a lower cavity space 880, thereby allowing for a wider storage drawer than in conventional assemblies. Due to the increased height of oven cavity 810, the oven hinge assemblies 220, 250 are secured to the front vertical support columns 230, 260 at a different vertical position as compared to oven housing assembly 100. Because the footprint of the oven housing assembly 810 is the same, the lower support frame 320 components can be used.

Thus, the housing assembly described herein provides for the use of components that are common to a plurality of different appliance configurations. Using common components leads to a reduction in part variants across the multiple different layouts, such as multiple oven cavity sizes, gas or electric ovens, etc., which reduces complexity. Regardless of the layout, in each configuration, the primary load paths are the same. The base of the appliance collects all loads in the same manner, from the four vertical support columns. These columns provide load paths for each of the cooktop assembly, the oven cavity via the rear component plate, the lower component plate, and the oven door hinge assemblies. Additionally, the use of variable cavity sizes with a single side panel configuration results in the need to attach components at different locations along the length of the vertical support columns depending upon the desired layout. Thus, the components (e.g. the vertical support columns) do not include bite holes or other predetermined fastener locations. Rather, during assembly, self-piercing or self-tapping fasteners can be employed to secure the rear component plate and oven door hinge assemblies, for example, at the desired locations along the vertical support columns, depending on the oven cavity size being accommodated within the housing.

FIG. 10 illustrates the lack of such predetermined fastener positions or bite holes along the vertical support columns. As noted above, each vertical support column 260, 270 can include an elongated trough, rib, emboss, or bead 265, 275 extending a substantial portion of its length. For instance, the bead 265, 275 can extend continuously from a top portion to a bottom portion of the column 260, 270. This bead 265, 275 extends as a recess in at least one face of the column 260, 270, such as a wall or surface facing an opposed side panel. It can be introduced via stamping or other metalworking techniques. Ideally, it is formed by metalworking rather than as an extrusion, because the process of bending the metal to form the bead 265, 275 introduces work-hardening into the column 260, 270, thus providing increased localized strength and buckling resistance in the vicinity of its longitudinal bends. At least one other face or wall of the vertical support column can also include a second strengthening trough, emboss, rib, or bead 277. The present example includes the strengthening rib 277 provided in an adjacent, inner wall of the column 270; however, it is to be appreciated that the second bead can be additionally or alternatively provided in an outer wall of the column. The column 270 may comprise only three walls, such that it has a substantially c-shaped cross section, with the open side facing the adjacent side panel.

Due to the elongated bead 265, 275, the vertical support column 260, 270 is capable of withstanding greater loads, both static and dynamic, than a column made from an equivalent material without the bead 265, 275. As shown, the bead 265, 275 can be of a substantially rectangular shape and includes parallel lateral edges. Such a configuration provides a mechanism to easily and quickly localize, align and install attached components to the column 260, 270, such as via brackets that are sized to be received within a recessed width of the bead 265, 275. Loads carried by the vertical support column 260, 270 are principally carried at lateral portions of the column adjacent to where the bends of the bead 265, 275 have been introduced. These are generally the strongest portions of the column 260, 270, and loads introduced via components fastened within the bead 265, 275 will be transferred to the lateral portions to be carried downward toward the ground or appliance supporting surface. Thus, weight loads will tend to be concentrated adjacent the lateral portions of the column 260, 270, rather than being uniformly distributed throughout the column 260, 270. Prior to reaching the underlying support rail or surface on which a bottom end of the column 260, 270 rests, it is desirable to redistribute the carried loads more evenly to avoid localized-pressure points, which are more likely to result in point failures. Thus, in a lower region of the column 260, 270, a second bead 268, 278 having a substantially triangular shape is provided. The second bead 268, 278 is configured with the widest portion closest to bead 265, 275 and as the bead progresses downward, a width (W) thereof gradually reduces until it is completely eliminated, thereby forming a v-shaped recess just above the bottom end of the column 260, 270. In this way, a uniform contour is gradually introduced into the column 260, 270 (or at least to the surface thereof carrying the bead) adjacent to its bottom end. This will have the effect of redistributing weight loads from the lateral portions uniformly about the bottom end of the column 260, 270 (or again, at least through its face bearing the bead), rather than driving those loads into an adjacent base rail concentrated at the lateral portions of the column 260, 270. In essence, while the bead structure 265, 275 introduces greater strength and buckling resistance into the column 260, 270 along its length, it also has the effect of concentrating loads adjacent the fortified, lateral portions of the column. The narrowing feature or v-shaped recess of the second bead 268, 278 redistributes those loads uniformly about the column 260, 270 or its face before they are delivered to the corresponding base rail. A third bead 269, 279 is positioned at a top portion of the vertical support column 260, 270 to maintain the symmetry of the side panel, thereby allowing the side panel to be right and left side agnostic.

The vertical support columns 230, 240, 260, and 270 are of a material and thickness that can withstand not only the static loads of supported components, but transient loads that may be encountered during shipping and agency testing of the appliance. At the same time, for cost- and weight-savings it is desirable to use hollow columns that are made from sheeting that is as thin as possible while still being strong enough to sustain the encountered loads.

Although embodiments described herein are made with reference to example embodiments, it should be appreciated by those skilled in the art that various modifications are well within the scope and spirit of this disclosure. Therefore, the scope of the example embodiments is not limited herein. The disclosure is intended to include all such modifications and alterations disclosed herein or ascertainable herefrom by persons of ordinary skill in the art without undue experimentation. It will be appreciated that a hinge system and appliance body construction configured in accordance with the examples shown herein can be used for a wide variety of other appliances such as clothes washers and dryers, dishwashers and the like.

What is claimed is:

1. A housing assembly for a cooking appliance comprising:

first and second opposed side panels, each of the first and second side panels having integral front and rear vertical support columns;

a front frame secured between the first and second side panels;

a rear component plate secured between the first and second side panels; and an oven cavity enclosed by the first and second side panels, the front frame, and the rear component plate, wherein a load of the oven cavity is carried by the rear vertical support columns, wherein the front frame has a first opening through which a portion of a first hinge assembly extends and a second opening through which a portion of a second hinge assembly extends, such that no loads from the first and second hinge assemblies and no load from the oven cavity are carried by the front frame.

2. The housing assembly of claim 1, wherein the first hinge assembly is mounted to the front and rear vertical support columns of the first side panel and the second hinge assembly is mounted to the front and rear vertical support columns of the second side panel.

3. The housing assembly of claim 1, each of the first and second side panels having a vertical axis of symmetry.

4. The housing assembly of claim 1, further comprising a lower support frame, the lower support frame including a first base rail positioned adjacent a bottom portion of the first side panel and a second base rail positioned adjacent a bottom portion of the second side panel.

5. The housing assembly of claim 4, the first and second base rails configured to collect accumulated loads from the housing assembly via the front and rear vertical support columns.

6. The housing assembly of claim 1, the front frame having a bottom edge positioned above a lower space within the housing assembly, the lower space accommodating one of a storage drawer, a warming drawer, or a cooking cavity, in any case being wider than the oven cavity.

7. A housing assembly for an appliance comprising:

a first side panel and a second side panel, each of the first and second side panels being right- and left side agnostic;

first front and rear vertical support columns integrated with the first side panel, the first front and rear vertical support columns forming first and second load paths;

second front and rear vertical support columns integrated with the second side panel, the second front and rear vertical support columns forming third and fourth load paths;

a substantially non-load bearing front frame having a first side secured to the first front vertical support column and a second side secured to the second front vertical support column; and a non-load bearing rear panel having a first side secured to the first rear vertical support column and a second side secured to the second rear vertical support column, wherein all loads in the appliance travel through one or more of the first, second, third, and fourth load paths.

8. The housing assembly of claim 7, further comprising a lower support frame and a plurality of feet, the lower support frame configured to receive the loads from the first, second, third, and fourth load paths and transfer the loads into the plurality of feet.

9. The housing assembly of claim 7, wherein the loads in the appliance include loads from an oven cavity and loads from an oven door.

10. The housing assembly of claim 7, wherein top portions of each of the first front and rear vertical support columns and the second front and rear vertical support columns are configured to support a cooktop assembly thereon.

11. A housing assembly for an appliance comprising:

a first side panel having a first pair of vertical support columns;

a second side panel positioned opposite the first side panel and having a second pair of vertical support columns;

an oven cavity positioned between the first side panel and the second side panel;

a rear component plate secured to and configured to support the oven cavity, a first side of the rear component plate secured to one of the first pair of vertical support columns and a second side of the rear component plate secured to one of the second pair of vertical support columns;

a first door hinge component secured to at least one of the first pair of vertical support columns; and a second door hinge component secured to at least one of the second pair of vertical support columns.

12. The housing assembly of claim 11, further comprising a front frame and a space provided below a lower edge of the front frame, the lower space configured to receive a drawer therein.

13. The housing assembly of claim 12, wherein a width of the drawer provided in the lower space is the same or greater than a width of the oven cavity.

14. The appliance of claim 11, wherein each of the vertical support columns includes an elongated bead recessed within a wall thereof.

15. The appliance of claim 11, wherein each of the vertical support columns is formed from an edge portion of the first or second side panel bent onto itself.

16. The appliance of claim 11, further comprising a lower component plate positioned at a lower rear portion of the appliance and having a first side secured to one of the first pair of vertical support columns and a second side secured to one of the second pair of vertical support columns.

17. The appliance of claim 16, further comprising a counterweight carried by the lower component plate.

18. The appliance of claim 11, further comprising a plurality of base rails configured to support the plurality of vertical support columns.

* * * * *